US006023865A

United States Patent [19]

Preuss

[11] Patent Number: 6,023,865

[45] **Date of Patent: *Feb. 15, 2000**

[54] LABEL

[76] Inventor: Jürgen Preuss, Sachsenstr. 25, 40883, Ratingen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/792,069

[22] Filed: Feb. 3, 1997

[30] Foreign Application Priority Data

Feb. 2, 1996 [DE] Germany ..... 196 03 671

[51] Int. Cl.[7] ..... G09F 3/00

[52] U.S. Cl. ..... 40/310; 40/306; 40/638

[58] Field of Search ..... 40/306, 307, 310, 40/311, 324, 630, 638, 661.05, 27.5

[56] References Cited

U.S. PATENT DOCUMENTS

| | | | |
|---|---|---|---|
| 1,209,998 | 12/1916 | Pinckert | 40/311 X |
| 1,632,347 | 6/1927 | Pipkin | 40/310 X |
| 1,872,159 | 8/1932 | McCreary | 40/307 |
| 3,204,359 | 9/1965 | Kurokawa | 40/307 |
| 4,389,802 | 6/1983 | McLaren et al. | 40/307 |
| 5,172,936 | 12/1992 | Sullivan et al. | 40/306 X |
| 5,592,766 | 1/1997 | Mygatt | 40/307 |

*Primary Examiner*—Brian K. Green

*Attorney, Agent, or Firm*—John F. A. Earley; John F. A. Earley III; Harding, Earley, Follmer & Frailey

[57] ABSTRACT

A round label for providing identifying indicia on a bottle having a bottom wall having a flat, annular edge portion and a concave depression in the middle of the annular edge portion. The label has an attachment for attaching the label in the concave depression of the bottle. The attachment includes a ring-shaped edge portion having a layer of adhesive on at least one side to affix the label to the side walls of the concave depression, and a circular interior labeling portion which is surrounded by the ring-shaped edge portion and which traverses the concave depression. A plurality of notches are provided in the edge portion of the label. The notches extend radially-inwardly towards the center of the label. The edge portion of the label is bent transverses to the labeling portion of the label and fastened to the side walls in the concave depression such that the labeling surface traverses the concave depression and is spaced apart from the flat annular edge portion of the bottom wall of the bottle.

7 Claims, 2 Drawing Sheets

LABEL

BACKGROUND OF THE INVENTION

The present invention pertains to a label with a round base. Labels of this class are used as, e.g., bottom labels (see International Design Patent No. DM/030 922). Compared with the use of conventional labels, which are placed on the body of the bottle, the use of bottom labels offers the advantage that bottom labels can also be read with the bottles being stored in a lying position. They are therefore especially suitable for labeling wine bottles, which are stored in special racks. If conventional labels are used, the bottles must be removed from the rack for identification.

The state of the art as well as the object of the present invention are described principally based on the example of bottom labels for bottles, but without limitation to bottles.

Such bottom labels are applied according to the state of the art by bonding to the bottom surface of the bottle. However, this has the drawback that the labels are easily rubbed off or damaged when the bottle is placed on its bottom surface.

Attachment to the bottom of the bottle, which is usually designed as a truncated cone-shaped bottom toward the inside, is difficult because of the only linear edge/connection area.

SUMMARY OF THE INVENTION

The basic object of the present invention is to improve a label of the above-described type such that the labels are protected and their application is facilitated.

The accomplishment of this object, including advantageous embodiments and variants of the present invention, arises from the contents of the patent claims, which follow this specification.

According to the basic idea of the present invention, the round base of the label comprises a ring-shaped edge surface and a round label surface, and the edge surface has notches (slots) in the direction of the center of the label.

Bottles usually have the above-mentioned truncated cone-shaped depressions in the direction of the neck of the bottom on their underside, so that a ring-shaped bottom surface is formed, as a result of which the stability of the standing bottle is increased. The design of the labels according to the present invention offers the advantage that the labels do not need to be bonded to the bottom surface, as before, but they can be arranged in the depressions, recessed in relation to the bottom surface by its specially designed edge surface and they are thus protected from rubbing off and soiling. At the same time, an enlarged edge strip is made available for attachment to the bottle.

To guarantee a reliable application of the label in the depression, the edge surface of the label is bent over. It is achieved due to this bending over that the label is in contact with the bottle in the area of its more or less entire edge surface, as a result of which a sufficiently large bonded surface is formed. Due to the notches of the edge surface in the direction of the center of the label, which are provided according to the present invention, the label is prevented from being "creased" during its application in the area of the depression. The notches may have, in principle, any desired shape; they may be, e.g., V-shaped ("open" toward the outside) or semicircular. The object is also accomplished by simple, radial incisions. The recessed arrangement of the labels guarantees a simple fitting and fastening, as a result of which the appearance of the labels applied is improved.

According to one exemplary embodiment of the present invention, provisions are made for designing at least the reverse side of the edge surface of the label as a pressure-sensitive side. The application of the labels is facilitated by this design, and soiling of the bottle or of the label by adhesive is not to be feared.

This can be accomplished in an especially simple manner by designing at least the reverse side of the edge surface of the label as an adhesive film. However, an embodiment in which the labels are designed as wet labels is conceivable as well.

However, the label may also be designed as a two-sided adhesive film. Such an embodiment makes possible, e.g., the use of unprinted labels (basic labels), which are applied by peeling off the protective film on the reverse side of the label in the bottle. A second, round, printed label (auxiliary label), whose size corresponds to the size of the label surface, can then be bonded on the front side of the basic label by peeling off the protective film in the area of the surface of the label.

It is also conceivable to design an unprinted basic label as a pressure-sensitive label only on the reverse side or at least in the area of its reverse-side edge surface and to attach the printed auxiliary label by means of an adhesive, or to provide the printed auxiliary label with an adhesive film on its reverse side. Such an embodiment offers the advantage of making it possible to manufacture the labels according to the present invention in large numbers and to use prior-art printed stickers or labels as auxiliary labels.

The bending over of the edge surface in the direction of the bottom surface of the bottle (with the label attached) may be facilitated by preparing a fold, embossing or perforation along the line separating the edge surface from the label surface.

Such a perforation facilitates especially the peeling off of the protective film when the label is designed as an adhesive film, and it avoids damage to the label by incompletely separating protective film.

To guarantee an exchange of air between the depression of the bottom of the bottle, which is sealed by the label, and the environment, one embodiment provides for the label having at least one hole. This hole permits, e.g., the evaporation of liquid. The durability of the label is improved hereby. It is also conceivable to make the hole so large that the label surface will be ring-shaped.

The present invention also pertains to the use of the above-described label as a bottom label for bottles, wherein the label is bonded in the depression of the bottom of the bottle, and the edge surface of the label, which is bent over preferably in the direction of the bottom surface of the bottle in the attached position, is used as the bonding surface.

Additional features of the present invention will appear from the features of the subclaims as well as the other application documents.

BRIEF DESCRIPTION OF THE DRAWINGS

Exemplary embodiments of the present invention, which will be described below, are shown in the drawing.

DESCRIPTION OF PREFERRED EMBODIMENT

Figure 1:
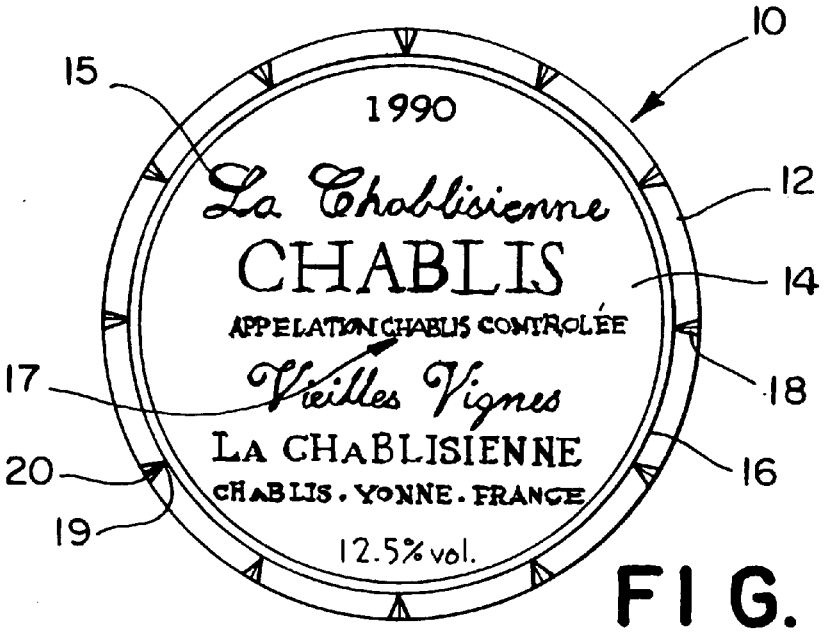
FIG. 1 shows a bottom label.

FIG. 1 shows a bottom label 10 with round cross section, which comprises a ring-shaped edge surface 12 as well as a round label surface 14. The line 16 separating the two surfaces is indicated by a bold, black marking line here. The label surface 14 has a typical label print 15, which provides information on the origin, the vintage, as well as the kind of wine contained in the corresponding bottle. The edge surface 12 of the bottom label 10 is provided with notches 18 in the direction of the center of the label 17 at angular distances of 30° each. The notches 18 are designed as isosceles triangles, wherein the vertex 19 of the triangle is located on the line 16 separating the label surface 14 from the edge surface 12. The base of the triangular notches 18 corresponds to chord sections 20 of the arc-shaped circumference of the bottom label 10.

Figure 2:
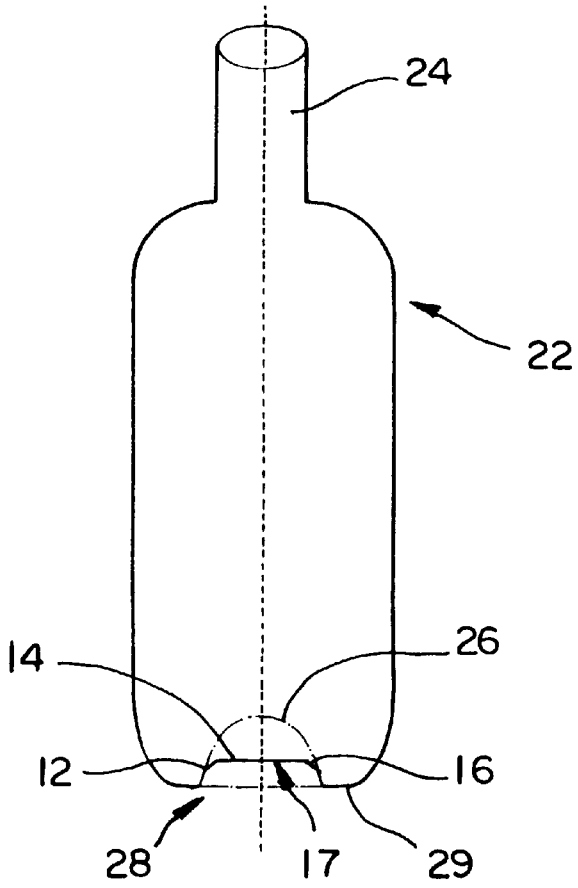
FIG. 2 shows a section through a bottle with a bottom label according to FIG. 1 attached.

FIG. 2 shows a bottle 22 with a depression 26 within the bottle bottom 28 pointing in the direction of the neck 24 of the bottle. A bottom label 10 is attached to the depression 26, recessed in relation to the bottom surface 29.

To attach the bottom label 10, the edge surface 12 has been bent over along the line 16 separating the edge surface 12 from the label surface 14. The edge surface 12 points toward the bottom surface 29 of the bottle 22. The label 10 is provided with an adhesive film on its reverse side in the area of the edge surface 12, so that the bottom label 10 is applied simply by applying pressure after the edge surface 12 has been bent over, and the notches 18 are spread apart in the edge surface 12.

Figure 3A:
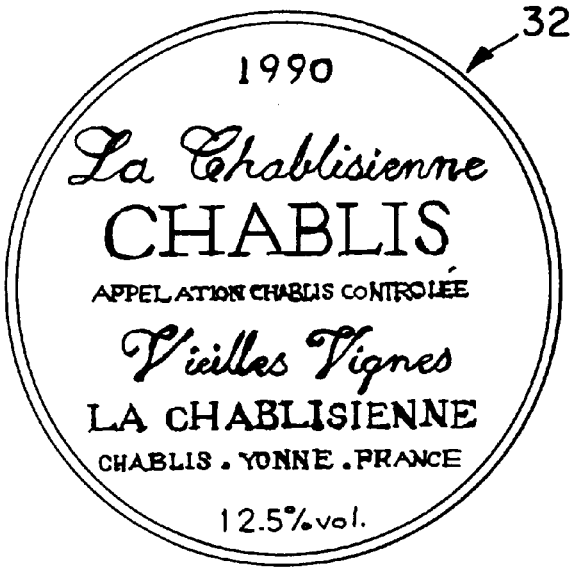
FIGS. 3A and 3B show an auxiliary label and a basic label.
Figure 3B:
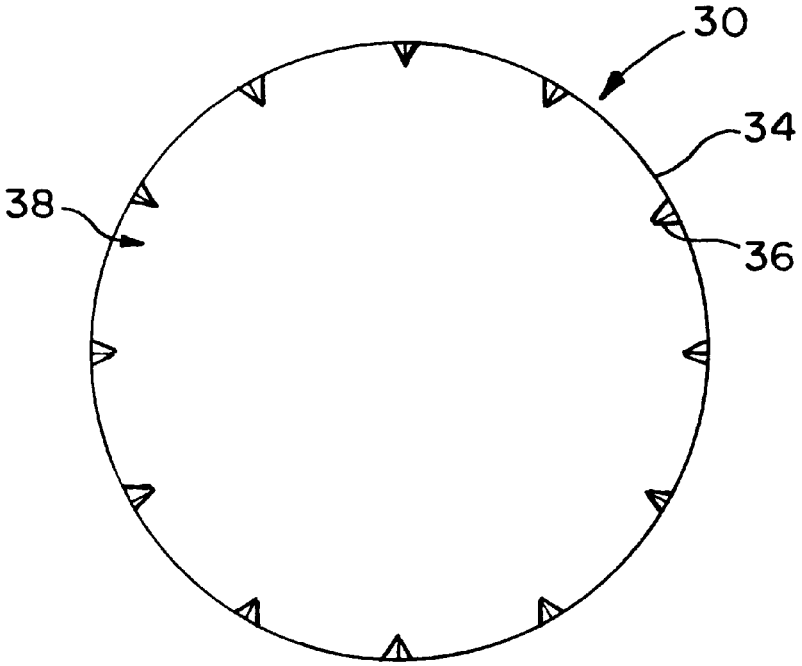

FIGS. 3A and 3B show another exemplary embodiment of the label according to the present invention, wherein the label is formed by a basic label 30 and an auxiliary label 32. The basic label 30 corresponds to that described in FIG. 1, but it has no print on it. Beginning from the edge 34 of the circular basic label 30, triangular notches 38 are also provided in the said basic label at angular distances of 30°. Such basic labels 30 can be manufactured in large numbers and can be used universally. They are arranged in the depression of the bottom of the bottle as shown in FIG. 2. Auxiliary labels 32 are used to label the contents of the bottle. While the basic label 30 is provided with an adhesive film on one of its sides in the area of the edge surface 38, its other side is designed such that the auxiliary label 32 can be attached with ease. The auxiliary label 32 is designed as a sticker, i.e., its reverse side is pressure-sensitive after it has been freed from a protective film. The auxiliary label 32 may be attached to the basic label 30 before the latter is placed in the depression of the bottom of the bottle, but it is also possible to attach the basic label 30 first and to attach the auxiliary label 32 to same thereafter.

The features of the subject according to the documents, which are disclosed in the present specification, the patent claims, the abstract and the drawings, may be essential for the realization of the present invention in its various embodiments individually as well as in any combination with one another.

I claim:

1. A bottle having identifying indicia, comprising:

a) a neck portion, a main body portion having a diameter wider than said neck portion, and a bottom wall having a flat annular edge portion and a concave depression in the middle of the annular edge portion, said concave depression having side walls and no radially-inwardly protruding lip; and b) a round label having a center, the label being affixed to the bottle in said depression, said label comprising:

i) a ring-shaped edge portion having a layer of adhesive on at least one side;

ii) a circular interior labeling surface surrounded by the ring-shaped edge portion of the label; and, iii) a plurality of notches in said edge portion of the label, said notches extending radially-inwardly toward the center of said label, said edge portion of said label being bent transverse to said labeling surface and fastened to said side walls of said concave depression, said labeling surface traversing said concave depression and being spaced apart from the flat annular edge portion of the bottom wall of the bottle.

2. The label of claim 1, the label having a front side and a reverse side, the adhesive layer on the ring-shaped edge portion of the label being provided on the reverse side of the label, and the adhesive layer being a pressure sensitive adhesive.

3. The label of claim 1, the label having a front side and a reverse side, the adhesive layer on the ring-shaped edge portion of the label being provided on the reverse side of the label, and the adhesive layer comprising an adhesive film.

4. The label of claim 1, the label having a front side and a reverse side, and the label having pressure sensitive adhesive on the front side and the reverse side.

5. The label of claim 1, the label having a fold, embossing, or perforation between the ring-shaped edge portion and the interior labeling surface.

6. The label of claim 1, the notches in the edge portion of the label being V-shaped.

7. The label of claim 1, the notches in the edge portion of the label being arranged at equal angularly spaced locations.

* * * * *